United States Patent [19]

Stursberg

[11] Patent Number: 4,688,456

[45] Date of Patent: Aug. 25, 1987

[54] APPARATUS FOR PUNCHING OF ANGULAR STEEL PROFILES

[75] Inventor: Bernd Stursberg, Ennepetal, Fed. Rep. of Germany

[73] Assignee: Carl Ullrich Peddinghaus, Wuppertal-Barmen, Fed. Rep. of Germany

[21] Appl. No.: 853,729

[22] Filed: Apr. 18, 1986

[30] Foreign Application Priority Data

Apr. 18, 1985 [DE] Fed. Rep. of Germany ..... 3513954

[51] Int. Cl.[4] ..... B21D 28/30; B21D 28/32

[52] U.S. Cl. ..... 83/368; 83/370; 83/527; 83/560; 408/12; 408/13

[58] Field of Search ..... 83/368, 370, 527, 560; 408/12, 13

[56] References Cited

U.S. PATENT DOCUMENTS

| | | | |
|---|---|---|---|
| 3,858,471 | 1/1975 | Valente | 83/368 |
| 4,040,320 | 8/1977 | Cloup | 83/368 |
| 4,407,614 | 10/1983 | Muhr et al. | 83/368 X |

FOREIGN PATENT DOCUMENTS 2557240 7/1976 Fed. Rep. of Germany .

*Primary Examiner*—Donald R. Schran

*Attorney, Agent, or Firm*—Karl F. Ross; Herbert Dubno

[57] ABSTRACT

An apparatus for punching of an angular steel profile comprises a feed conveyor and a discharge conveyor for the angular steel profile, a rigid frame portion, two punch carriages and at least one punch carriage positioning motor for moving the punch carriages mounted on the frame portion and a servomechanism for positioning at least one of the punch carriages according to the tolerances, particularly the angular tolerances, of the angular steel profile to be worked. The servomechanism for positioning the punch carriage has a compressively loaded roller sensor contacting on a reference surface of the angular steel profile and a signaling member operated by the roller sensor. The feed conveyor, the discharge conveyor and the punches are equipped for feeding and working a vertically oriented V-shaped angular steel profile. The angular steel profile to be worked is movable by the frame portion and the punch carriages with the help of a clamp member oriented vertically, traveling horizontally and gripping the angular steel profile in a channel through the working zone. The clamp member passes through a clamp slot connected to the working zone. An outer surface of the angular steel profile not to be worked by the punch is used as a reference surface.

9 Claims, 5 Drawing Figures

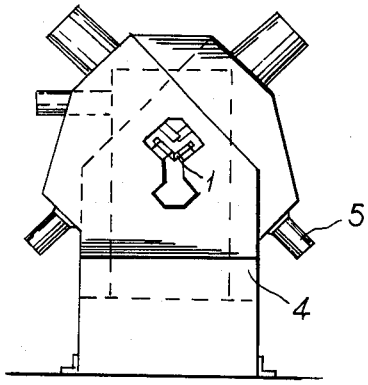
FIG. 2
FIG. 3
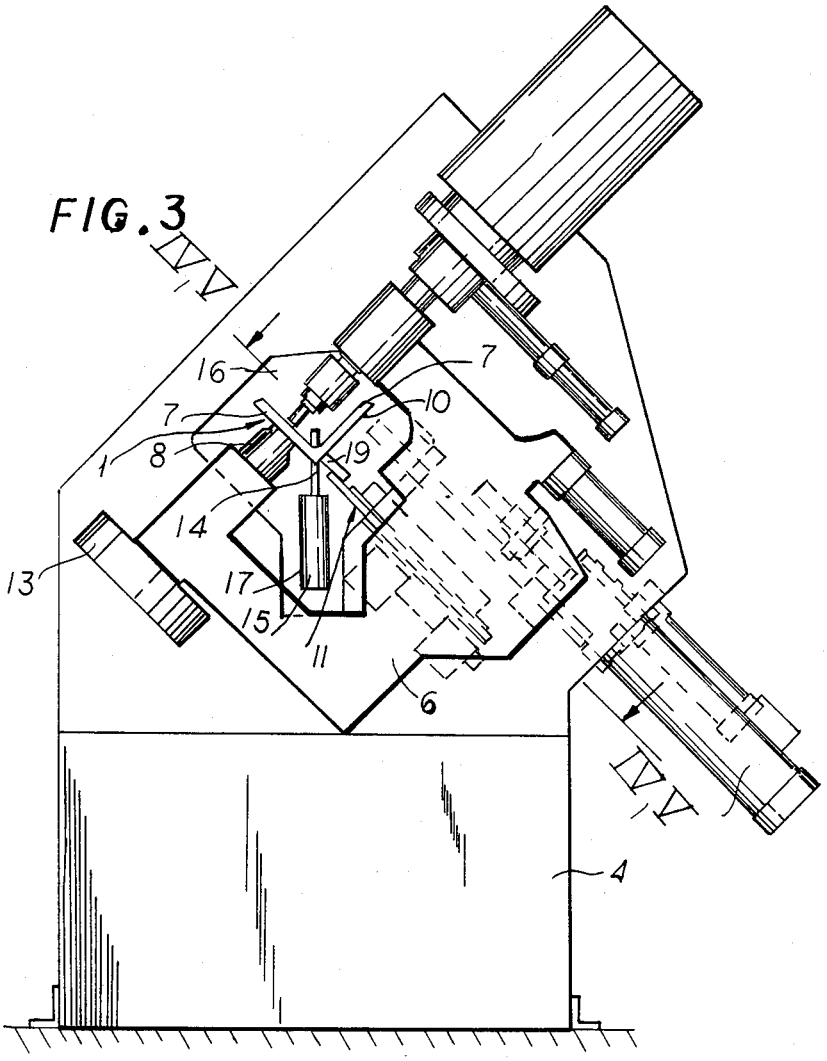

APPARATUS FOR PUNCHING OF ANGULAR STEEL PROFILES

CROSS REFERENCE TO RELATED APPLICATIONS

This invention is related to the following commonly assigned copending applications:

Ser. No. 547,743 filed Nov. 1, 1983, now allowed, Ser. No. 645,602 filed Aug. 29, 1984, now U.S. Pat. No. 4,600,099 Ser. No. 801,610 filed Nov. 25, 1985, now allowed, Ser. No. 819, 540 filed Jan. 16, 1986, now allowed, Ser. No. 834,797, filed Feb. 28, 1986, now U.S. Pat. No. 4,632,365 Ser. No. 640,438, filed Mar. 17, 1985.

FIELD OF THE INVENTION

My invention relates to an apparatus for punching of angular steel profiles, sections, bars and the like, hereinafter simply referred to as angles or as steel structural shapes.

BACKGROUND OF THE INVENTION

An angular steel profile can be punched with an apparatus that comprises a feed conveyor and a discharge conveyor for the angular steel profile, a rigid frame portion, two punch carriages and at least one punch carriage positioning motor or servomotor for moving the punch carriages mounted on the frame portion in a working aperature. A mechanism is provided for controlling the position of at least one of the punch carriages according to the tolerances, particularly the angular tolerances, of the angular steel profile to be worked.

The mechanism for positioning the punch carriage has a pressure loaded roller sensor contacting a reference surface of the angular steel profile and a signaling member operated by the roller sensor.

The angular steel profile travels into the apparatus, is positioned, and then is punched.

The apparatus of German Open Patent Application Document DE-OS No. 25 57 240 has its parts equivalent to the punch carriages pivotally mounted opposite one another and also duplicated one behind the other. They cooperate with the angular steel profile. The feed conveyor, discharge conveyor and the punch for feeding and working an angular steel profile are oriented so that one profile flange would be vertical and the other would be horizontal. A clamp member to aid in at least partially guiding the angular steel profile by a frame portion of this apparatus and the punch carriages is not provided and furthermore can not be. The structure of the apparatus does not allow such a transport mechanism, because the mechanism for positioning would interfere with it, when such a position mechanism is installed for both punch carriages.

OBJECTS OF THE INVENTION

It is an object of my invention to provide an improved apparatus for punching a steel profile, particularly an angular steel profile or section which overcomes drawbacks of earlier systems.

It is also an object of my invention to provide an improved apparatus for punching a steel profile which has greater precision even with large manufacturing tolerances of the steel profile and comparatively large deviations from linearity.

It is a further object of my invention to provide an improved apparatus for punching a steel profile which can be provided with a clamp member for drawing the angular steel profile through the apparatus even where both punch carriages are equipped with a positioning mechanism.

SUMMARY OF THE INVENTION

These objects and others which will be made more apparent hereinafter are attained in an apparatus for punching an angular steel profile comprising a feed conveyor and a discharge conveyor for the angular steel profile, a rigid frame portion, two punch carriages and at least one punch carriage positioning motor for moving the punch carriages mounted on the frame portion in a working zone in at least one punch which acts on a flange of the angular steel section and a punch carriage positioning servomechanism at least one of the punch carriages according to the tolerances, particularly the angular tolerances, of the angular steel profile to be worked.

The servomechanism for positioning the punch has a pressure loaded roller sensor or member pressed against a reference surface of the angular steel profile and a signaling member or position detector operated by the roller sensor.

According to my invention the feed conveyor, the discharge conveyor and the punches are equipped for feeding and working a vertically oriented V-shaped angular steel profile with its flange upwardly divergent, its crotch facing upwardly and its crest turned downwardly.

The punch carriages can travel in directions perpendicular to each other as well as at an angle of 45 degrees to vertical.

The angular steel profile to be worked is drawn by the vertical tongs or clamp engaging the crotch and crest, the tongs or clamp member being oriented vertically, traveling horizontally and gripping the angular steel profile in a channel of the working zone, which has a clamp slot enlarged according to the needs of the positioning system.

An outer surface of the angular steel profile not to be worked by the punch is used as the reference surface and the sensor can comprise a roller sensor member traveling perpendicularly to the reference surface and carrying the signaling member.

According to a further feature of my invention the roller sensor has two sensing rollers whose spacing from each other in the direction of travel of the angular steel section corresponds approximately to the width of the associated punch carriages. That guarantees that a sufficiently precise repositioning can be made within the tolerances of the standard angular steel profiles, especially despite the unavoidable variations of the angle between the flanges of the angular steel profile from perpendicularity. This can be accomplished in a simple and reliable way in the apparatus according to my invention.

My invention also provides in one embodiment that the roller sensor carriage is U-shaped in projection substantially perpendicularly to one of its motion directions, and the sensing rollers are mounted on a cross piece of the roller sensor carriage. The roller sensor carriage is positioned with one U-leg downstream of the associated punch carriages and with the other U-leg upstream of the associated punch carriages, while at least one of the U-legs is connected to a pressing mechanism. Advantageously the motion of the roller sensor carriage relative to the punch carriages is detectable by the signalling member. Also the roller sensor carriage is securable relative to the frame portion in a drawn back or retracted position and the motion of the punch carriages is detectable relative to the roller sensor carriage and thus the frame portion by the signaling member.

Both carriages or only one punch carriage can be equipped with a repositioning mechanism within the framework of my invention. Of course my apparatus for punching an angular steel profile can also be used to work a steel profile or section with a different cross section, for example a rectangular cross section.

The advantages of my invention are attained in a structure having a clamp member which assists easily in moving the angular steel profile to be worked by the frame member and the punch carriages. The described tolerances are no trouble. The track alignment control is such that each punched hole has the same spacing from the profile flange, the outer surface of which is used as the reference surface. Of course the punch process is performed after the repositioning has been started. In some cases independently of the angle between the flanges of an angular steel profile a so-called hole matrix must be adhered to. In such a case the repositioning mechanism in the apparatus of my invention can be disengaged.

BRIEF DESCRIPTION OF THE DRAWING

The above and other objects, features and advantages of my invention will become more readily apparent from the following specific description, reference being made to the accompanying highly diagrammatic drawing in which:

FIG. 2 is a front elevational view of the apparatus of FIG. 1 in the direction of the arrow II with the feed conveyor removed;

FIG. 3 is an enlarged front elevational view of the apparatus of FIG. 2 shown without the front covering plate;

SPECIFIC DESCRIPTION

Figure 1:
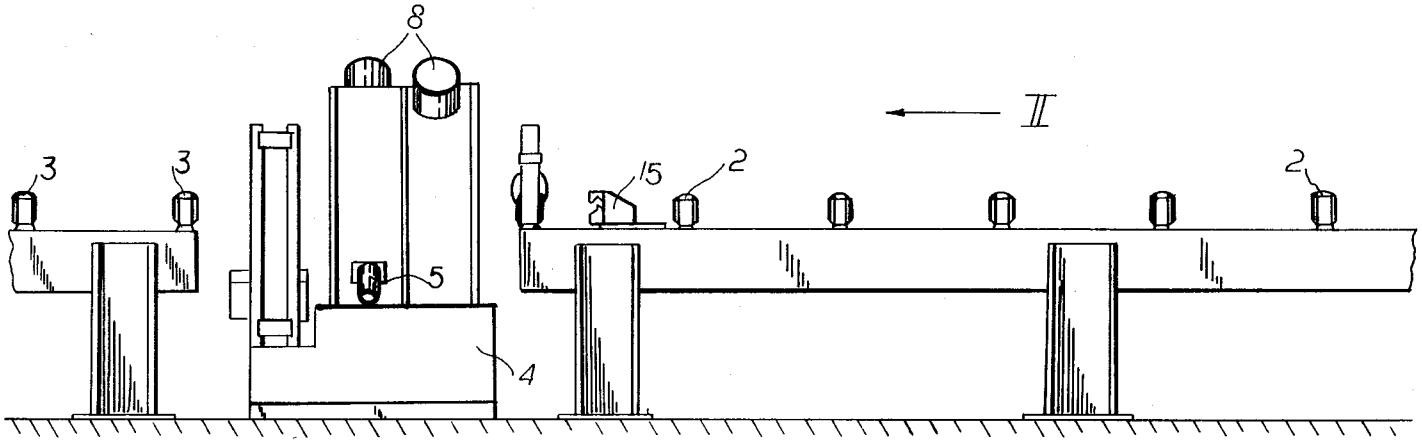
FIG. 1 is a schematic side elevational view of an apparatus for punching steel profiles according to my invention.

An apparatus for punching an angular steel profile is shown in the drawing. In FIGS. 2 and 3 a cross section through one such angular steel profile 1 can be seen.

The basic structure of this apparatus comprises a feed conveyor 2 and a discharge conveyor 3 for the angular steel profile 1, a rigid frame portion 4, two punch carriages 6 and at least one punch carriage positioning motor 5 for moving a punch carriage 6 mounted on the frame portion 4. At least part of said punch carriage 6 protrudes into a working zone of a punch 8 which acts on a flange 7 of the angular steel profile 1. A mechanism 9, is provided for repositioning at least one of the punch carriages 6 according to the tolerances, particularly the angular tolerances, of the angular steel profile 1 to be worked.

The punch carriage positioning motor 5 may, for instance, be of the servomotor or of take piston-cylinder, motor type. The positioning of motor 5 is weight compensated, i.e. counterbalanced. Consequently the positioning is accomplished with a very slight applied force very precisely. The mechanism 9 for repositioning of the punch carriages 6 has a roller sensor 11 contacting on a reference surface 10 of the angular steel profile 1 and a signaling member 12 operated by the roller sensor 11. The signaling member 12 can control the associated punch carriage positioning motor 5.

From FIGS. 1 and 2 one sees that the feed conveyor 2, the discharge conveyor 3, and the punch 8, are equipped for feeding and working the angular steel profile 1 which is oriented so as to be V-shaped in relation to vertical. The punch carriages 6 travel perpendicular to each other and at an angle of 45 degrees to vertical. In FIG. 2 this travel for the punch carriages 6 is indicated by the double arrows. FIG. 3, which only shows one punch carriage 6, is provided with an appropriate double arrow also and the punch carriage 6 is only indicated with dashed guide lines against the frame portion 4. The support 13 for the movable punch carriages 6 is shown in FIG. 3.

From FIGS. 1 and 3 one sees that the angular steel profile to be worked on is movable by the frame portion 4 and the punch carriages 6 with the aid of a clamp member 15 vertically positioned, horizontally movable and gripping the angular steel profile 1 in the channel 14 (crotch of V-shaped profile). This clamp member 15 has a suitable clamp slot 17 connected to a working zone 16 of the punches 8 enlarged according to the needs of the repositioning.

Figure 4:
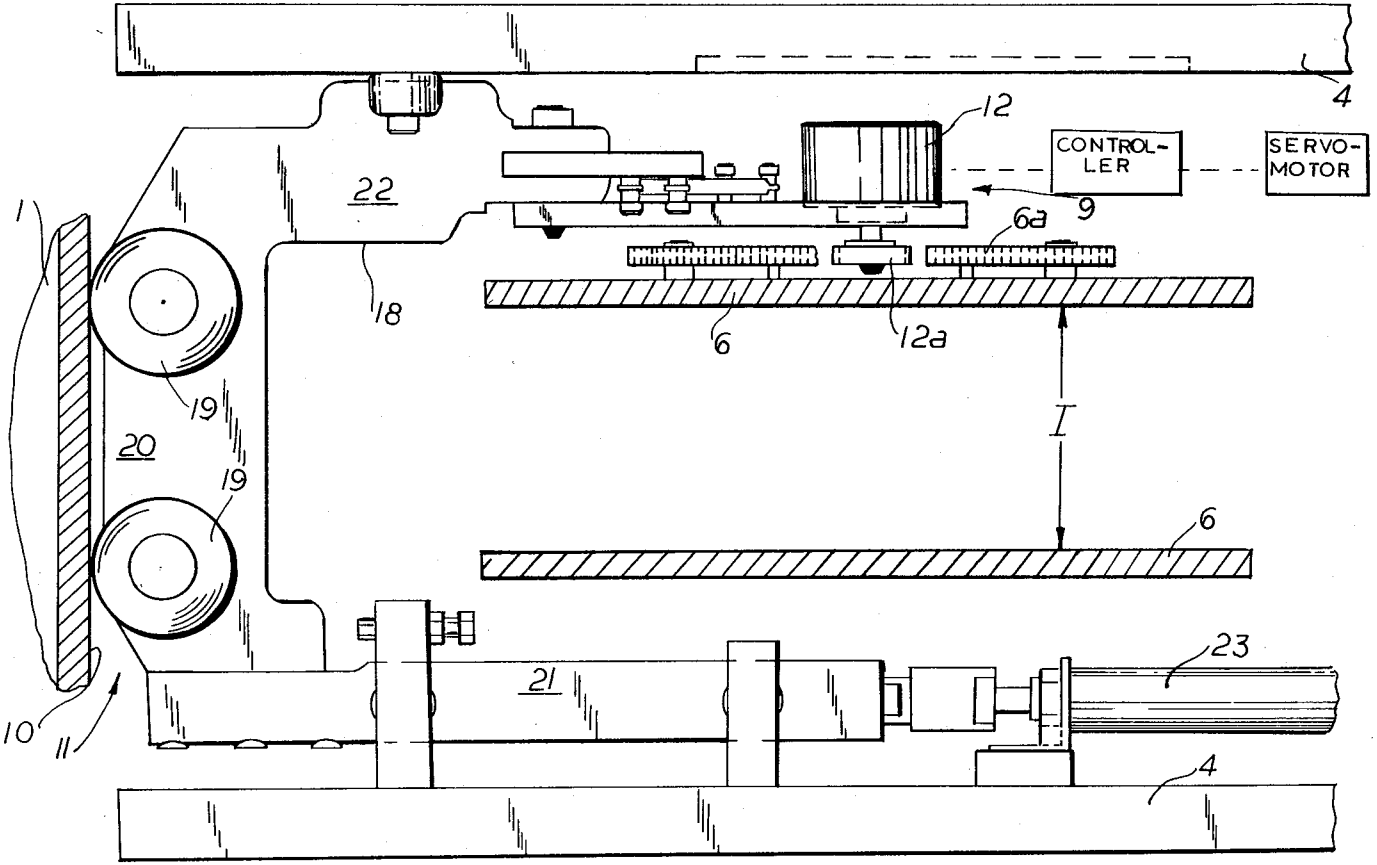
FIG. 4 is an enlarged cross sectional view of the apparatus of FIG. 3 taken along the section line IV—IV.

As can be seen particularly from FIGS. 3 and 4 the outer surface of a flange 7 of the angular steel profile 1 to be worked on by the punch 8 is a reference surface 10 and the roller sensor 11 is positioned in the working aperature 16 and is mounted with a roller sensor carriage 18, which is movable perpendicular to the associated reference surface 10 in the frame portion 4. It also carries a signaling member 12.

The roller sensor 11 has in this example and according to a particular embodiment of my invention two sensing rollers 19 spaced from each other a distance approximately equal to the width H of the associated punch carriage 6 in the transport direction of the angular steel profile 1.

Figure 5:
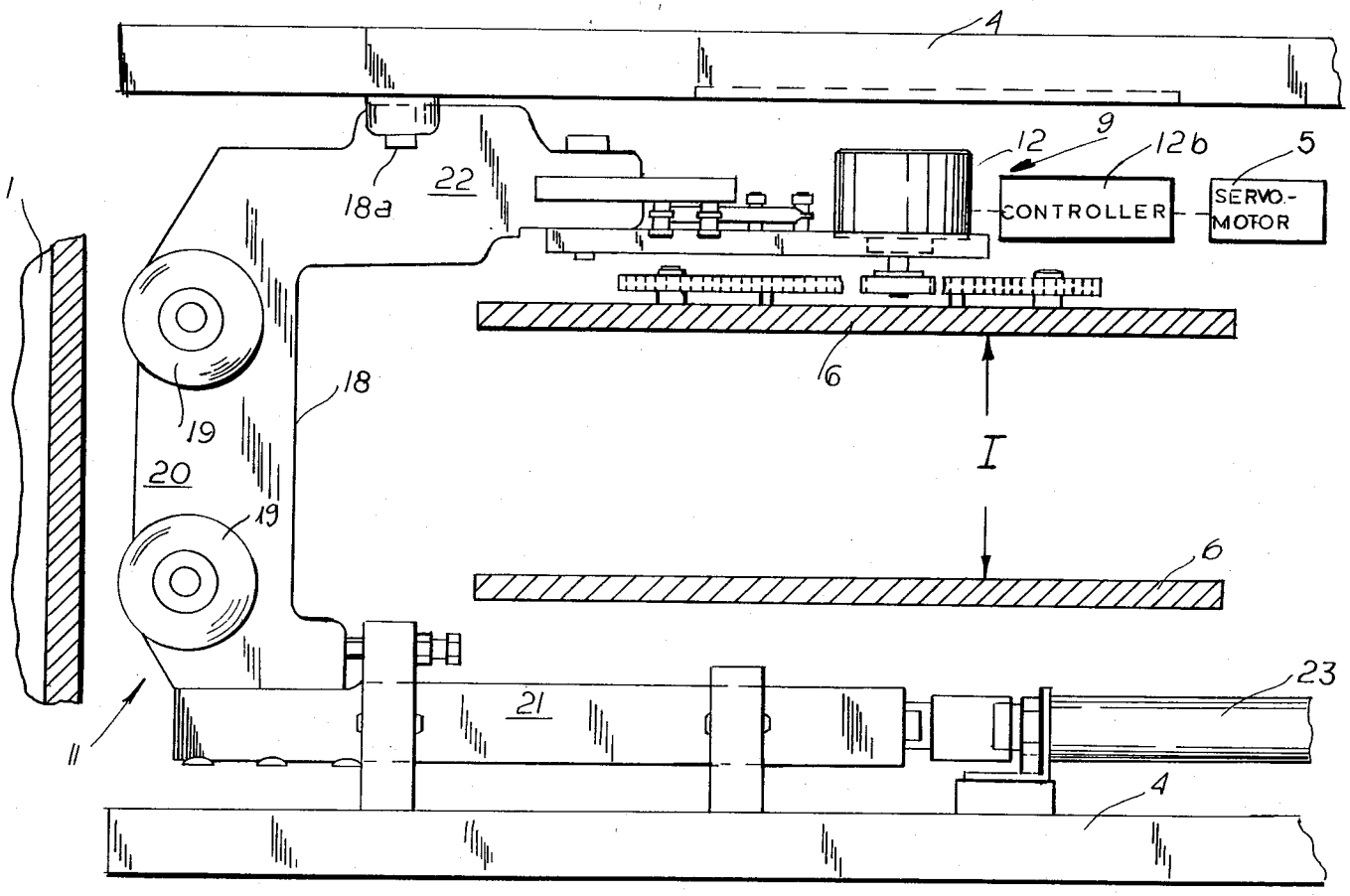
FIG. 5 is an enlarged cross sectional view of the apparatus of FIG. 3 taken along the section line V—V of FIG. 3 in a different operating configuration.

It is particularly clear from FIG. 4 that the roller sensor carriage 18 is formed U-shaped and oriented perpendicularly to its motion direction, has the sensing rollers 19 on the cross piece 20, and is mounted with one U-leg 21 downstream of the associated punch carriages 6 and the other U-leg 22 upstream of the associated punch carriages 6. One of the U-legs 21 is connected to a pressing mechanism 23. The other is connected to a signaling member 12. With the signaling member 12 the motion of the roller sensor carriage 18 relative to the punch carriages 6 is ascertainable. These relationships and structures are shown in FIG. 4. The roller sensor carriage 18 can be fixed in a retracted position relative to the frame portion 4. That is shown in FIG. 5. With the signaling member 12, which is carried by the roller sensor carriage 18, the motion of the punch carriages 6 relative to the roller sensor carriage 18 and thus to the frame portion 4 is detectable.

In the operating configuration shown in FIG. 4 the apparatus for punching of an angular steel profile of my invention works so the punch carriages first move and then their motion is detected. The roller sensor carriage 11 moves. It detects the tolerances which are built into the work piece 1. This motion is detected by the signaling element 12 and can be analyzed under suitable technical control. In the operating configuration shown in FIG. 5 the roller sensor carriage 18 is fixed in position. It can be blocked by the cylinder piston mechanism 23 comprising the pressing mechanism, so the signaling member 12 detects the motion of the punch carriage 8 and the measurement guides the control mechanism. In both functional configurations the measurement results from the same signaling member 12 and thus the same measuring mechanism.

The signaling member 12 can have a pinion 12*a* meshing with the rack 6*a* on the carriage 6. The signaling member 12, using standard servomechanism principles is connected to a controller 12*b* which delivers an error signal to the punch motor 5 (FIG. 5). In the retracted position shown in this FIGURE, the signaling member responds to the displacement of the carriage 6 relative to the frame 4 on which the member 18 is guided, e.g. by rollers and shaft of which is visible at 18*a*. When the member 8 is biased against the surface 10 by cylinder 23, the signaling member 12 responds to the relative position of the carriage 6 relative to this surface.

I claim:

1. An apparatus for punching an angle structural steel shape which comprises:

a punch frame;

means for guiding said angle in said frame for movement therethrough with flanges of said angle diverging upwardly and a crest thereof turned downwardly;

means engageable vertically with said angle at said crest and in a crotch between said flanges for drawing said angle through said frame;

at least two punches, each punch juxtaposed with one of said flanges and displaceable perpendicularly on said frame to said one of said flanges, said punches being provided with a carriage each and a motor for controlled displacement of said carriage in a control direction perpendicular to the direction of displacement of said punch, said carriages traveling in directions approximately perpendicular to each other as well as at an angle of 45° to vertical;

a sensor of distortion of said angle mounted on said frame and including:

a roller sensor provided with wheels bearing upon a reference surface of said angle at the other of said flanges and guided on said frame for movement in said control direction, a signaling member communicating with said roller sensor for signaling the position of said roller sensor and controlling the positioning of said motor, and fluid-pressure means for pressing said roller sensor toward said reference surface and said other flange.

2. The apparatus defined in claim 1 wherein said roller sensor has two guide rollers riding upon said surface and spaced apart in a direction of displacement of said angle by substantially the width of said carriage.

3. The apparatus defined in claim 2 wherein said roller sensor in a projection orthoganol to said control direction has a generally U-shape with a pair of substantially parallel arms and a web connecting said arms, one of said arms being provided with said fluid-pressure means, the other of said arms being provided with said signaling member and said web carrying said rollers.

4. The apparatus defined in claim 3 wherein said signaling member is coupled with said carriage for signaling the position of said roller sensor relative to said carriage.

5. The apparatus defined in claim 3 wherein said rolling sensor is retractable from said angle and said signaling member signals the movement of said carriage relative to said frame in the retracted position of said roller sensor.

6. In an apparatus for punching an angular steel profile, section or the like comprising a feed conveyor and a discharge conveyor for said angular steel profile, a rigid frame portion, two punch carriages and at least one punch carriage positioning motor for moving said punch carriages mounted in said frame portion in a working zone in at least one punch which acts on a flange of said angular steel profile, and a punch carriage positioning mechanism at least one of said punch carriages according to the tolerances, particularly bowing of said angular steel profile to be worked, wherein said punch carriage positioning mechanism of said punch carriage has a compressively loaded roller sensor contacting on a reference surface of said angular steel profile and a signaling member operated by said roller sensor, the improvement wherein said feed conveyor, said discharge conveyor and said punch are equipped for feeding and working a vertically oriented V-shaped one of said angular steel profiles and said punch carriages can travel in directions approximately perpendicular to each other as well as at an angle of about 45 degrees to vertical, said angular steel profile to be worked being movable by said frame portion and said punch carriages with the aid of a clamp member oriented vertically, traveling horizontally and gripping said angular steel profile in a channel through said working zone, which has a clamp slot connected thereto enlarged according to the needs of said repositioning, an outer surface of said angular steel section not to be worked on in said punch being used as said reference surface and said roller sensor being connected to at least one of said punch carriages associated with said working zone and comprising a roller sensor carriage which travels perpendicularly to said reference surface carrying said signaling member.

7. The improvement defined in claim 6 wherein said roller sensor further comprises two sensing rollers, whose spacing from each other in the direction of travel of said angular steel section corresponds approximately to the width of said associated punch carriages.

8. The improvement defined in claim 7 wherein said roller sensor carriage is U-shaped oriented substantially perpendicularly to a motion direction of said roller sensor carriage, said sensing rollers are mounted in a cross piece of said roller sensor carriage and said roller sensor carriage is positioned with one U-shaped leg downstream and with the other U-leg upstream of said associated punch carriages, wherein at least one of said U-legs is connected to a pressing mechanism.

9. The improvement defined in claim 8 wherein said roller sensor carriage is securable in a retracted position and with said signalling member the motion of said punch carriages relative to said roller sensor carriage and thus said frame portion is detectable.

* * * * *